US009009866B2

(12) United States Patent
Blakely

(10) Patent No.: US 9,009,866 B2
(45) Date of Patent: Apr. 21, 2015

(54) CONVERTIBLE GARMENT CUFF

(71) Applicant: Erica Blakely, Braselton, GA (US)

(72) Inventor: Erica Blakely, Braselton, GA (US)

( * ) Notice: Subject to any disclaimer, the term of this patent is extended or adjusted under 35 U.S.C. 154(b) by 13 days.

(21) Appl. No.: 13/909,381

(22) Filed: Jun. 4, 2013

(65) Prior Publication Data

US 2013/0318683 A1 Dec. 5, 2013

Related U.S. Application Data

(60) Provisional application No. 61/655,462, filed on Jun. 4, 2012.

(51) Int. Cl.

| | |
|---|---|
| ***A41B 7/10*** | (2006.01) |
| ***A41B 7/04*** | (2006.01) |
| *A41B 7/00* | (2006.01) |

(52) U.S. Cl.
CPC .... *A41B 7/10* (2013.01); *A41B 7/04* (2013.01)

(58) Field of Classification Search
CPC ..... A41B 7/00; A41B 7/10; A41B 7/04; A41B 7/12; A41B 7/02
See application file for complete search history.

(56) References Cited

U.S. PATENT DOCUMENTS

| | | | | | |
|---|---|---|---|---|---|
| 148,178 | A * | 3/1874 | Chase | 2/123 |
| 1,097,024 | A * | 5/1914 | Holverson | 2/124 |
| 1,239,944 | A * | 9/1917 | Newman | 2/124 |
| 1,391,205 | A * | 9/1921 | Newman | 2/123 |
| 1,484,187 | A * | 2/1924 | O'Neill et al. | 2/60 |
| 1,546,588 | A * | 7/1925 | Kilgore | 2/124 |
| 2,209,376 | A * | 7/1940 | Franz | 2/123 |
| D193,760 | S * | 10/1962 | Sanders | D2/858 |
| 3,137,861 | A * | 6/1964 | Sanders | 2/123 |
| 3,251,066 | A * | 5/1966 | Takacs | 2/46 |
| 3,520,001 | A * | 7/1970 | Chancellor, Jr. | 2/123 |
| 3,594,819 | A * | 7/1971 | Mullins et al. | 2/170 |
| 5,070,544 | A * | 12/1991 | Aliberti et al. | 2/170 |
| 6,212,685 | B1 * | 4/2001 | Kelly | 2/123 |
| 6,405,379 | B1 * | 6/2002 | Kelly | 2/123 |
| 6,430,747 | B1 * | 8/2002 | Lee | 2/60 |
| 7,380,287 | B2 * | 6/2008 | DeSantis | 2/123 |
| 7,962,969 | B1 * | 6/2011 | Blakely | 2/123 |
| D646,468 | S * | 10/2011 | Arrindell | D2/858 |
| 2005/0217005 | A1 * | 10/2005 | DeSantis | 2/123 |
| 2008/0229475 | A1 * | 9/2008 | DeSantis | 2/123 |
| 2008/0289152 | A1 * | 11/2008 | Surratt | 24/41.1 |
| 2010/0095427 | A1 * | 4/2010 | Romiti | 2/160 |
| 2011/0277213 | A1 * | 11/2011 | Stoehr et al. | 2/123 |
| 2012/0263895 | A1 * | 10/2012 | Jeter et al. | 428/34.1 |

OTHER PUBLICATIONS

"Shirt Cuffs Explained", Beckett & Robb blog, Sep. 12, 2012.

* cited by examiner

*Primary Examiner* — Bobby Muromoto, Jr.
(74) *Attorney, Agent, or Firm* — Kunzler Law Group, PC

(57) ABSTRACT

An apparatus for a convertible garment cuff includes a band of flexible material that includes a substantially rectangular body having first and second opposing edges, first and second opposing ends, a front side, and a back side. A portion of the body includes a covering region that conceals a garment cuff in an engaged position. A portion of the body includes a tucking region that tucks underneath the garment cuff in an engaged position. A plurality of coupling elements secures the body to the garment cuff in an engaged position. The covering region includes at least one coupling element disposed along each of the first and second opposing ends. The tucking region includes at least one coupling element disposed along at least one of the first and second opposing ends. The first and second opposing ends of the covering and tucking regions are coupled together.

20 Claims, 9 Drawing Sheets

CONVERTIBLE GARMENT CUFF

CROSS-REFERENCES TO RELATED APPLICATIONS

This application claims the benefit of U.S. Provisional Patent Application Ser. No. 61/655,462 entitled "Shirt Cuff Converters" and filed on Jun. 4, 2012, for Erica Blakely Bridges, which is incorporated herein by reference.

FIELD

This invention relates to garment cuffs and more particularly relates to changing the appearance of a garment cuff using a convertible garment cuff.

BACKGROUND

In general, various types of garments include cuffs located on an end part of a sleeve. For example, a long-sleeve dress shirt includes cuffs at the end of each sleeve. Other garments, such as trousers, jackets, dresses, etc., may also include cuffs, or cuff-like elements. Cuffs are typically made from the same material as the rest of the garment, which may include the same material type, color, texture, print, etc. Cuffs may be formed by turning back the material of a sleeve on itself or by sewing on a separate band of material.

However, because cuffs are typically attached to a garment in a permanent manner, it may be difficult to change the appearance of the cuff without performing major modifications to the garment, such as removing the existing cuff and sewing on a new cuff. Moreover, it may be desirable to be able to easily change the appearance of the cuff to match the appearance of different accessories, such as ties, vests, socks, purses, etc., or to add a touch of flair to an outfit.

SUMMARY

From the foregoing discussion, it should be apparent that a need exists for an apparatus for converting a garment cuff. Beneficially, such an apparatus would allow a user to change and customize the appearance of a garment cuff.

The subject matter of the present application has been developed in response to the present state of the art, and in particular, in response to the problems and needs in the art that have not yet been fully solved by currently available garment cuff converters. Accordingly, the present disclosure has been developed to provide an apparatus for converting a garment cuff that overcomes many or all of the above-discussed shortcomings in the art.

The apparatus, in one embodiment, includes a band of flexible material that includes a substantially rectangular body having first and second opposing edges, first and second opposing ends, a front side, and a back side. In another embodiment, a portion of the body includes a covering region that conceals a garment cuff in an engaged position. In yet another embodiment, a portion of the body includes a tucking region that tucks underneath the garment cuff in an engaged position. A plurality of coupling elements, in one embodiment, secures the body to the garment cuff in an engaged position.

In some embodiments, the covering region includes at least one coupling element disposed along each of the first and second opposing ends. In a further embodiment, the tucking region includes at least one coupling element disposed along at least one of the first and second opposing ends. In one embodiment, the first and second opposing ends of the covering region and the tucking region are coupled together.

In another embodiment, the body is folded lengthwise such that the covering region overlaps the tucking region. In one embodiment, the folded body forms an arc shape and engages the garment cuff such that the garment cuff is positioned between the covering region and the tucking region. In some embodiments, a coupling element comprises an opening. The garment cuff, in another embodiment, engages the body such that one or more openings disposed along each of the first and second edges of the covering region and the tucking region and one or more openings disposed on the garment cuff are aligned.

In one embodiment, a coupling element includes a linking member that is received through the one or more aligned openings disposed on the covering region, the tucking region, and the garment cuff to secure the body to the garment cuff in an engaged position. In another embodiment, the linking member comprising one of a button, a cuff link, and a snap.

In certain embodiments, the garment cuff comprises a barrel cuff. A coupling element, in one embodiment, interfaces with at least one opening disposed on the barrel cuff to secure the body to the barrel cuff in an engaged position. In another embodiment, a coupling element comprises one or more connecting members connecting the body to one or more buttons disposed on the barrel cuff to secure the body to the garment cuff in an engaged position. In one embodiment, a portion of the barrel cuff includes one or more buttons. In another embodiment, the portion of the barrel cuff including one or more buttons is folded in on itself while coupled to the body in an engaged position.

In one embodiment, the garment cuff includes a French cuff. In another embodiment, a coupling element interfaces with at least one opening disposed on the French cuff to secure the body to the French cuff in an engaged position.

In another embodiment, an interfacing is mechanically connected to the back side to reinforce the body. In one embodiment, the interfacing includes a band of flexible material substantially the same size as the body. In some embodiments, a width of the body is adjustable by coupling at least one opposing edge to the back side by one or more fastening members. In another embodiment, a width of the body is adjustable by connecting a coupling element disposed along the first opposing end of the covering region to a matching coupling element disposed along the second opposing end of the covering region. In a further embodiment, the covering region includes two or more coupling elements disposed along each of the first and second opposing ends.

In one embodiment, the apparatus includes one or more accessories. In another embodiment, an accessory is coupled to one or more of the body and one or more coupling elements. In yet another embodiment, the one or more accessories include a band of flexible material selectively coupled to the first and second opposing ends by one or more coupling elements. In certain embodiments, the band of flexible material being narrower than the body and covering a portion of the front side. In another embodiment, the one or more accessories include jewelry that is selectively coupled to the body by one or more coupling elements.

In one embodiment, the apparatus includes a backing element attached to the body, the backing element maintaining the placement of the body on the garment cuff in an engaged position. In another embodiment, the body includes first and second bands of flexible material having substantially the same size and shape. The first and second bands of flexible material, in some embodiments, include different visual appearances. In another embodiment, the first and second bands of flexible material are mechanically connected such that the body is reversible wherein the back side and the front side are interchangeable.

A garment cuff converter, in one embodiment, includes a band of flexible material that includes a substantially rectangular body having first and second opposing edges, first and second opposing ends, a front side, and a back side. In another embodiment, a portion of the body includes a covering region that conceals a garment cuff in an engaged position. The covering region, in one embodiment, includes one or more openings disposed along each of the first and second ends. In yet another embodiment, a portion of the body includes a tucking region that tucks underneath the garment cuff in an engaged position. The tucking region, in one embodiment, includes one or more openings disposed along each of the first and second ends. A cuff link, in one embodiment, secures the body to the garment cuff in an engaged position.

In one embodiment, the one or more openings disposed along each of the first and second opposing ends of the covering region, the one or more openings disposed along each of the first and second opposing ends of the tucking region, and one or more openings disposed on the garment cuff are aligned such that the cuff link is received through each opening to couple the covering region, the tucking region and the garment cuff together.

In a further embodiment, the garment cuff comprises a barrel cuff. A cuff link, in one embodiment, interfaces with at least one opening disposed on the barrel cuff to secure the body to the barrel cuff in an engaged position. In one embodiment, the garment cuff includes a French cuff. In another embodiment, a cuff link interfaces with at least one opening disposed on the French cuff to secure the body to the French cuff in an engaged position.

Another garment cuff converter, in one embodiment, includes a band of flexible material that includes a substantially rectangular body having first and second opposing edges, first and second opposing ends, a front side, and a back side. In another embodiment, a portion of the body includes a covering region that conceals a garment cuff in an engaged position. The covering region, in one embodiment, includes one or more openings disposed along each of the first and second ends. In yet another embodiment, a portion of the body includes a tucking region that tucks underneath the garment cuff in an engaged position. The tucking region, in one embodiment, includes one or more openings disposed along each of the first and second ends.

In a further embodiment, an interfacing is mechanically connected to the back side to reinforce the body. In one embodiment, the interfacing includes a band of flexible material substantially the same size as the body. A cuff link, in one embodiment, secures the body to the garment cuff in an engaged position. In one embodiment, the body is folded over itself lengthwise such that the covering region overlaps the tucking region. In another embodiment, the folded body forms an arc shape and engages the garment cuff such that the garment cuff is positioned between the covering region and the tucking region.

In one embodiment, the one or more openings disposed along each of the first and second opposing ends of the covering region, the one or more openings disposed along each of the first and second opposing ends of the tucking region, and one or more openings disposed on the garment cuff are aligned such that the cuff link is received through each opening to couple the covering region, the tucking region, and the garment cuff together.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, advantages, and characteristics of the embodiments may be combined in any suitable manner. One skilled in the relevant art will recognize that the embodiments may be practiced without one or more of the specific features or advantages of a particular embodiment. In other instances, additional features and advantages may be recognized in certain embodiments that may not be present in all embodiments. These features and advantages of the embodiments will become more fully apparent from the following description and appended claims, or may be learned by the practice of embodiments as set forth hereinafter.

Figure 1:
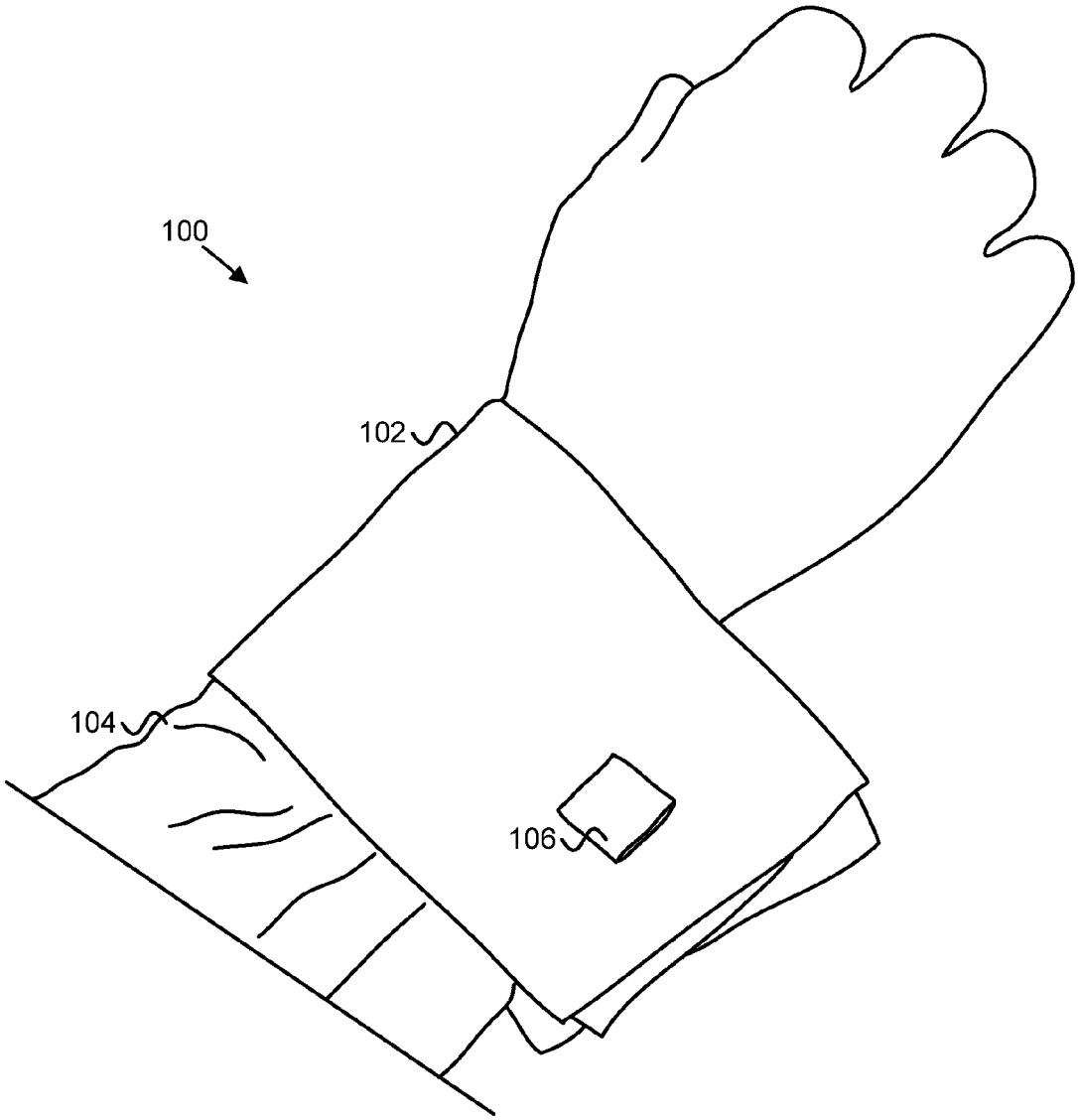
FIG. 1 is a perspective view illustrating one embodiment of a system for a convertible garment cuff in accordance with the present subject matter.

FIG. 1 depicts a perspective view illustrating one embodiment of a system 100 for a convertible garment cuff 102. In one embodiment, the system 100 includes a convertible garment cuff 102, a garment 104, and a coupling element 106. In certain embodiments, the convertible garment cuff 102 is designed to cover the existing cuff of the garment 104 and change the appearance of the garment 104. The convertible garment cuff 102, in one embodiment, includes a flexible material such that the convertible garment cuff 102 may be wrapped around the cuff of the garment 104 to cover the cuff of the garment 104. In certain embodiments, the flexible material includes various fabrics, or a combination of fabrics, such as cotton, polyester, rayon, nylon, wool, leather, or the like. In other embodiments, the flexible material includes various types of synthetic or semi-synthetic moldable materials such as plastic, nylon, rubber, or the like.

In some embodiments, the convertible garment cuff 102 includes a print on its surface that is different than the print on the surface of the garment 104. By installing the convertible garment cuff 102 on the cuff of the garment 104, the appearance of the garment 104 may be changed. In some embodiments, the print of the convertible garment cuff 102 may match the print on the surface of a separate accessory or piece of clothing, such as a tie, hat, socks, belt, purse, or the like. For example, a person may be wearing a white dress shirt with a blue tie. In order to add more color to the outfit, the person may install a convertible garment cuff 102 on the garment 104 that matches the color of the tie. Other convertible garment cuffs 102 may match different patterns, prints, textures, or the like, of various accessories.

The garment 104 may be any type of garment that includes at least one cuff. For example, the garment 104 may be a dress shirt that includes long or short sleeves with cuffs. In one embodiment, the garment 104 includes a button cuff or barrel cuff. A barrel cuff, as used herein, may include one or more buttonholes on one side of the cuff and one or more buttons on the opposite side of the cuff. In another embodiment, the garment 104 includes a link cuff, such as a single cuff or a French (double) cuff. A link cuff may include buttonholes on both sides of the cuff that may be closed with a linking member, such as a cuff link, silk knot, or the like. A French style cuff may be about twice as long as a single cuff and may be worn folded back on itself and closed with a linking member. In other embodiments, the garment 104 may include cuffs including a combination of buttons, cuff links, and other linking members.

In one embodiment, the cuff of the garment 104 may include the collar of a shirt, such as a dress shirt. The convertible garment cuff 102 may be designed to cover the collar and change its appearance. In other embodiments, the garment 104 may include a pair of trousers. The trousers may include a cuff, such as a cuff located at the end of a leg, and the convertible garment cuff 102 may be designed to cover the cuff of the leg and change its appearance. In some embodiments, the trousers include long trousers such as jeans, slacks, and the like. In other embodiments, the trousers include short trousers that have shorter legs than long trousers, with a cuff of the leg being located at about the knee of the person wearing the shorts. Although a few examples have been described, the convertible garment cuff 102 may be installed on any type of garment 104 that includes a cuff-like element, such as dresses, kilts, hats, athletic apparel, jackets, or the like.

The coupling element 106, in one embodiment, secures the convertible garment cuff 102 to the garment 104 in an engaged position. In various embodiments, the coupling element 106 may include a plurality of openings disposed on the convertible garment cuff 102. In other embodiments, the coupling element 106 may include a cuff link, a snap, a button, or any other type of linking member or fastener securing the convertible garment cuff 102 to the garment 104.

In one embodiment, the convertible garment cuff 102 includes flexible material that is formed or cut in a substantially rectangular shape. The flexible material may include a body comprising two opposing edges, two opposing ends, a front side 202 and a back side 212. The material, in other embodiments, includes different sizes and shapes to fit different types of individuals, such as men, women, plus-sized, children, or the like. In some embodiments, the material includes different sizes and shapes to fit different types of garments 104.

Figure 2A:
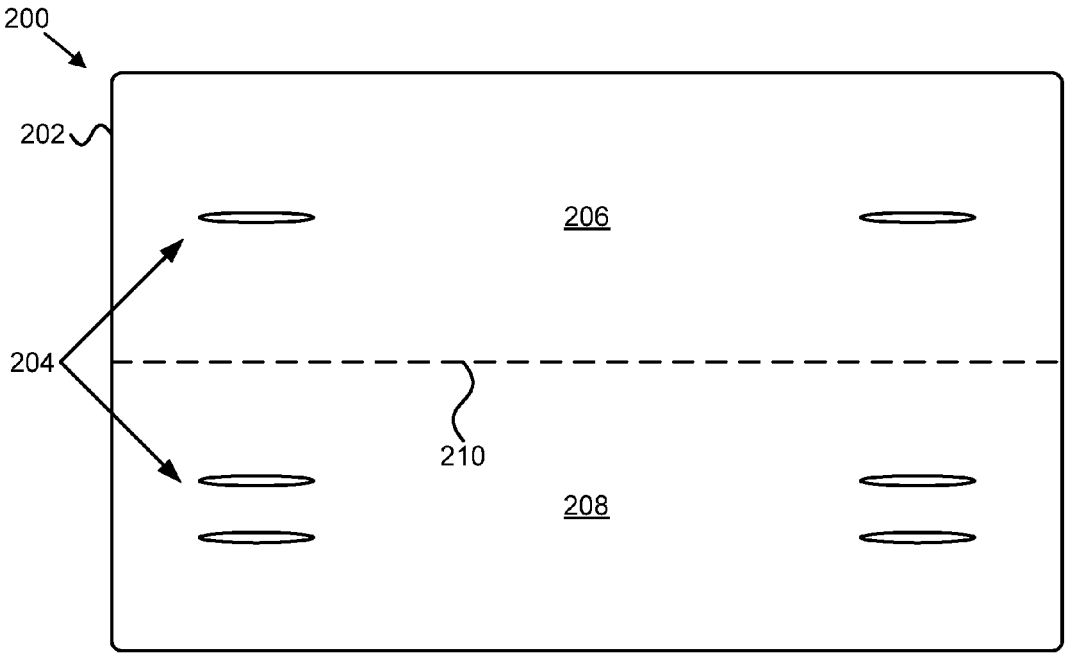
FIG. 2A is a perspective view of one embodiment of a front side of a convertible garment cuff in accordance with the present subject matter.

FIG. 2A is a perspective view of one embodiment 200 of a front side 202 of the body of a convertible garment cuff 102. In some embodiments, the front side 202 of the convertible garment cuff 102 includes one or more openings 204, a covering region 206, a tucking region 208, and a fold 210. Note that the fold 210 may vary depending on which openings 204 are used to secure the convertible garment cuff 102 in the engagement position. The front side 202 of the convertible garment cuff 102 may include a print on its surface that is visible when the convertible garment cuff 102 is installed on the garment 104. In certain embodiments, the print on the front side 202 of the convertible garment cuff 102 is the same as the print on the back side 212 of the convertible garment cuff 102. In other embodiments, the print on the front side 202 of the convertible garment cuff 102 is different than the print on the back side 212 of the convertible garment cuff 102. In other embodiments, the print on the front side 202 matches the print of an accessory being worn as part of an outfit, such as a tie, hat, purse, or the like.

The one or more openings 204 of the convertible garment cuff 102, in one embodiment, are designed to receive a linking member, such as a cuff link, silk knot, or the like, to help secure the convertible garment cuff 102 to the garment 104, as described below with reference to FIGS. 4 and 5. The one or more openings 204 may be various lengths and widths to accommodate the size and shape of a linking member. In some embodiments, the one or more openings 204 may be cut in the material and sewn in order to prevent the edges of the one or more openings 204 from fraying or tearing.

In some embodiments, the convertible garment cuff 102 includes one or more openings 204 along an edge of the covering region 206 and/or the tucking region 208 such that the width of the convertible garment cuff 102 may be adjusted to fit the cuff of the garment 104 in an engaged position. In the engagement position, the convertible garment cuff 102 may be folded at the fold 210. In other embodiments, the convertible garment cuff 102 includes one or more openings 204 along an edge of the covering region 206 and/or the tucking region 208 to accommodate more than one linking member. The depicted embodiment has two openings 204 included on each end of the tucking region 208, but one of skill in the art will recognize that more openings 204 may be included on the tucking region 208, the covering region 206, or both.

Figure 3:
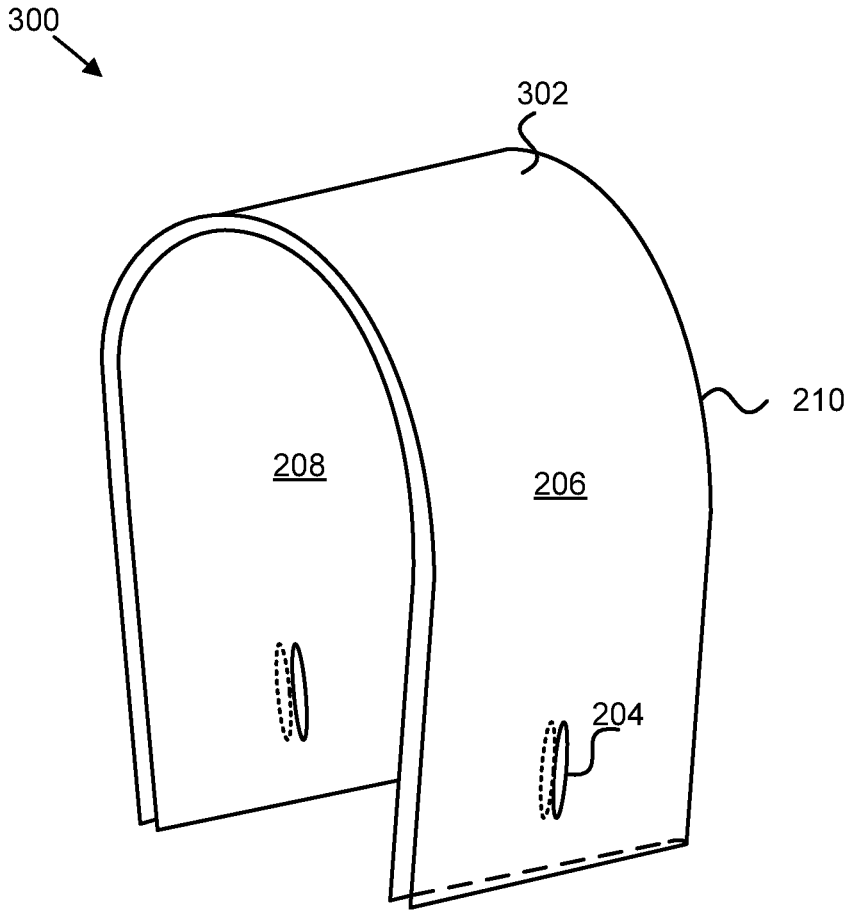
FIG. 3 is a perspective view of one embodiment of a convertible garment cuff in accordance with the present subject matter.
Figure 4:
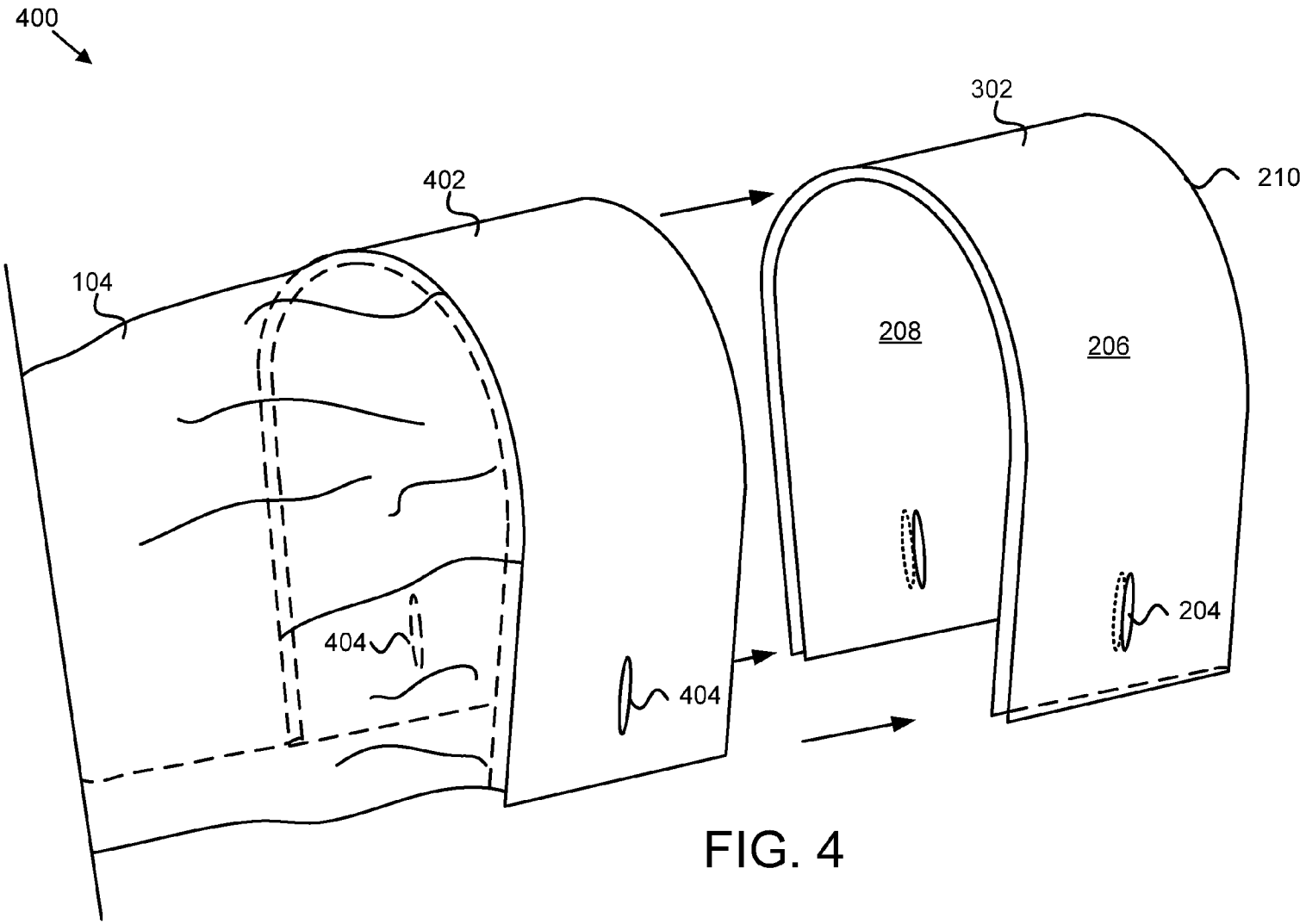
FIG. 4 is a perspective view of one embodiment of installing a convertible garment cuff in accordance with the present subject matter.
Figure 5:
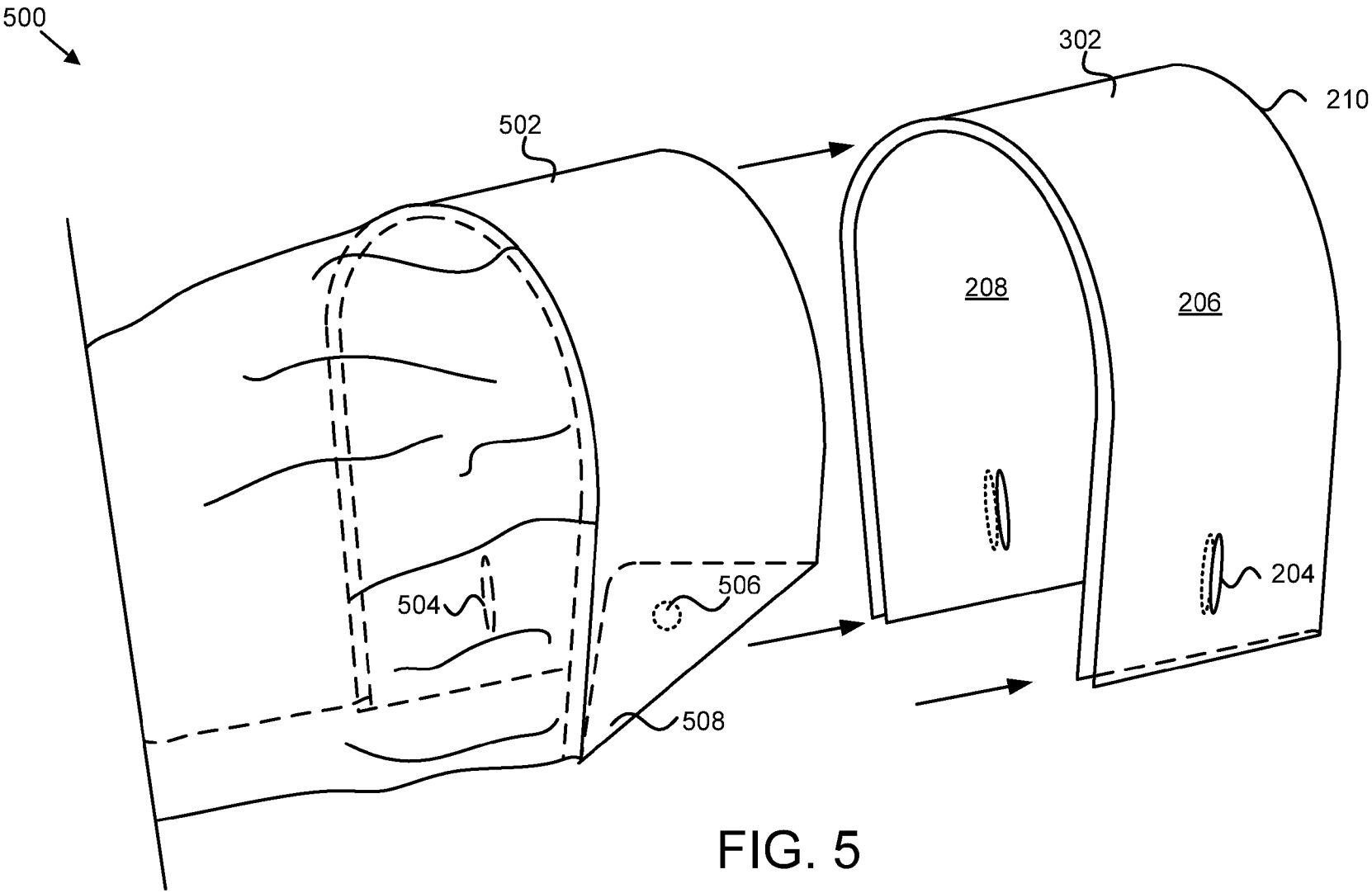
FIG. 5 is a perspective view of another embodiment of installing a convertible garment cuff in accordance with the present subject matter.

In certain embodiments, the convertible garment cuff 102 is folded over on itself to engage a cuff of a garment 104 in an engaged position, as depicted in FIGS. 3-5. The covering region 206, in one embodiment, covers a cuff of a garment 104 while the tucking region 208, in another embodiment, tucks under the cuff of the garment 104 such that the convertible garment cuff 102 is installed on the garment 104 in an engaged position. In certain embodiments, the convertible garment cuff 102 does not include a tucking region 208. For example, the convertible garment cuff 102 may include a covering region 206 that covers the cuff of the garment 104 without having any material that tucks under the cuff of the garment 104. In such an embodiment, the convertible garment cuff 102 may include additional securing elements, in addition to a linking member, to secure the convertible garment cuff 102 to the cuff of the garment 104 in an engaged position.

In another embodiment, the convertible garment cuff 102 includes a small tucking region 208 that does not wrap around far enough over the covering region 206 to connect through an opening 204. In the embodiment, the tucking region 208 may include a means of securing the tucking region 208 in a folded position. For example, the tucking region 208 may include an alternate coupling element with a corresponding coupling element on the covering region 206, such as snaps, hook and loop fastener, buttons, etc. In another example, the tucking region 208 and covering region 206 may include one or more devices to hold the tucking region 208 in the folded position, such as clips, shaped plastic, etc. within the convertible garment cuff 102 at the fold 210.

Figure 7:
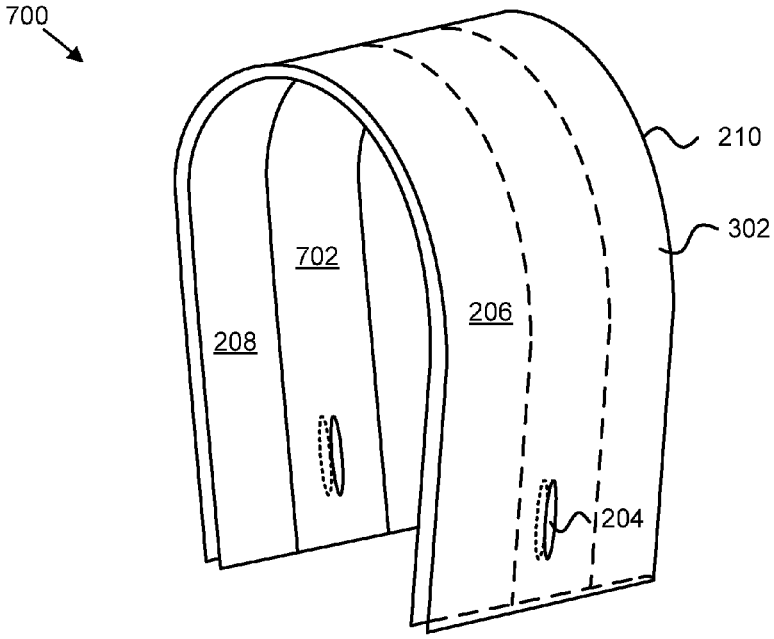
FIG. 7 is a perspective view of one embodiment of a convertible garment cuff with a backing installed in accordance with the present subject matter.

In an embodiment where the cuff is a collar of a garment 104, such as a dress shirt, the convertible garment cuff 102 may be designed to couple to the collar in an engaged position. The convertible garment cuff 102 may be angled or shaped to match a collar. A collar may be embodied as a point collar that includes a straight point collar or a button down point collar. In one embodiment, the convertible garment cuff 102 may include pockets sewn on the back side 212 of a covering region 206 that receives the points of the collar. In another embodiment, the convertible garment cuff 102 may include openings 204 that align with the openings on a button down collar and receive a button connected to the garment 104. In another embodiment, a backing, as depicted in FIG. 7, may be used to help couple the convertible garment cuff 102 to the collar. In certain embodiments, an additional securing member, such as the additional securing members depicted in FIGS. 10A and 10B, may be used to couple the convertible garment cuff 102 to the collar.

Figure 2B:
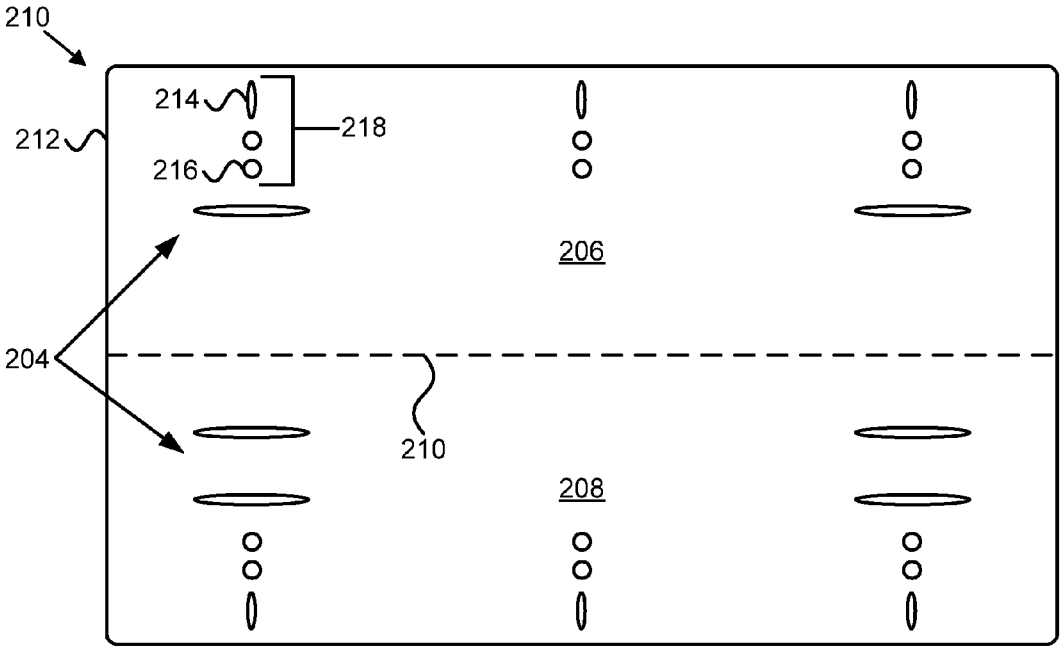
FIG. 2B is a perspective view of one embodiment a back side of a convertible garment cuff in accordance with the present subject matter.

FIG. 2B is a perspective view of one embodiment 210 of a back side 212 of a convertible garment cuff 102. The back side 212 of the convertible garment cuff 102, in some embodiments, includes one or more openings 204, a covering region 206, and a tucking region 208, which are substantially similar to the one or more openings 204, the covering region 206, and the tucking region 208 of the front side 202. The back side 212, in some embodiments, includes a width adjuster 218 that includes one or more openings 214 and one or more buttons 216.

In one embodiment, the one or more openings 214 on the edges of the body are folded over to selectively couple to the one or more buttons 216, which sets the width of the convertible garment cuff 102 depending on the particular button 216 that is coupled to the opening 214. The one or more openings 214 may be sized to fit buttons of various shapes and sizes. In other embodiments, the width adjuster 218 may use various types of securing elements, such as snap buttons, a hook-and-loop fastener, magnets, or the like to secure an edge of the body to itself.

In another embodiment, the width of the convertible garment cuff 102 is adjusted by matching an opening 204 along an end of the covering region 206 to a corresponding opening 204 on the opposite end of the covering region 206. One or more openings 204 may be disposed along both ends of the covering region 206, which provides more than one possible width to be set. A linking member, such as a cuff link, button, snap, or the like, may then be used to secure the ends of the covering region 206 together at the appropriate width.

In some embodiments, the back side 212 includes a print on its surface. In one embodiment, the print on the back side 212 is different than the print on the surface of the front side 202. In one embodiment, the body of a convertible garment cuff 102 includes a first band of flexible material and a second band of flexible material that are mechanically connected. The first and second bands of flexible material may be substantially the same size and shape and may each have a different print on their respective surfaces. In such an embodiment, the body of the convertible garment cuff 102 may be reversible such that the back side 212 and the front side 202 are interchangeable. For example, the front side 202 may have a blue print on its surface and the back side 212 may have a red print on its surface. An individual may customize the appearance of the convertible garment cuff 102 to match other articles of clothing, accessories, or the like, by reversing the convertible garment cuff 102. In an embodiment where the body of the convertible garment cuff 102 is reversible, the width adjuster 218 may not be installed on the back side 212.

FIG. 3 is a perspective view of one embodiment 300 of a convertible garment cuff 302 in a cuff engaging position. The convertible garment cuff 302, in one embodiment, is folded over itself and bent in an arc shape to match a shape of a cuff of the garment 104. In one embodiment, the body of the convertible garment cuff 302 is folded lengthwise at the fold 210 such that the covering region 206 overlaps the tucking region 208. In most embodiments, the cuff of the garment 104 is positioned between the covering region 206 and the tucking region 208 in an engaged position, as is shown in FIGS. 4 and 5. In the embodiment of FIG. 3, the one or more openings 204 line up in order to receive a linking member, such as a cuff link, a silk knot, or the like. The linking member, in certain embodiments, helps secure the convertible garment cuff 302 to the cuff of the garment 104 in an engaged position.

In other embodiments, the linking member may be received through two openings 204 on the covering region 206 and two openings 204 on the tucking region 208 such that each layer of the convertible garment cuff 302 are coupled to the cuff of the garment 104. In some embodiments, the linking member may be received through two openings 204 on the covering region 206 and only one opening on the tucking region 208. The tucking region 208, in such an embodiment, may have one end without an opening 204, the end without the opening 204 being folded-up on itself so as to not prevent the linking member from being received by the openings 204 on the opposite end.

In other embodiments, the tucking region 208 may be folded-in or cut in such a way as to not include one or more openings 204. In such an embodiment, a linking member would be received by one or more openings 204 disposed on the covering region 206 while bypassing the tucking region 208. For example, the corners of the tucking region 208 may be folded in on itself to accommodate a cuff link having a short stem, such that the cuff link does not have to be received through the flexible material comprising the tucking region 208.

FIG. 4 is a perspective view of one embodiment 400 of installing a convertible garment cuff 302 on a garment 104 that includes a French cuff 402. The French cuff 402 may include a pair of openings 404 that are typically used to couple the ends of the French cuff 402 together using a linking member, such as a cuff link. In one embodiment, the French cuff 402 is worn "kissing," where the ends of the French cuff 402 are pinched together and coupled with a cuff link. In another embodiment, the French cuff 402 is worn "barrel-style," where one end overlaps the opposite end and coupled using a cuff link.

In one embodiment, the convertible garment cuff 302 engages the French cuff 402 such that the openings 204 disposed on the covering region 206 and the tucking region 208 align with the openings 404 disposed on the French cuff 402. In most embodiments, the French cuff 402 engages the convertible garment cuff 302 such that the French cuff 402 is positioned between the covering region 206 and the tucking region 208. In certain embodiments, the tucking region 208 tucks underneath the French cuff 402 and the covering region 206 covers the French cuff 402 such that the French cuff 402 is concealed from view.

Figures 9A, 9B, 9C:
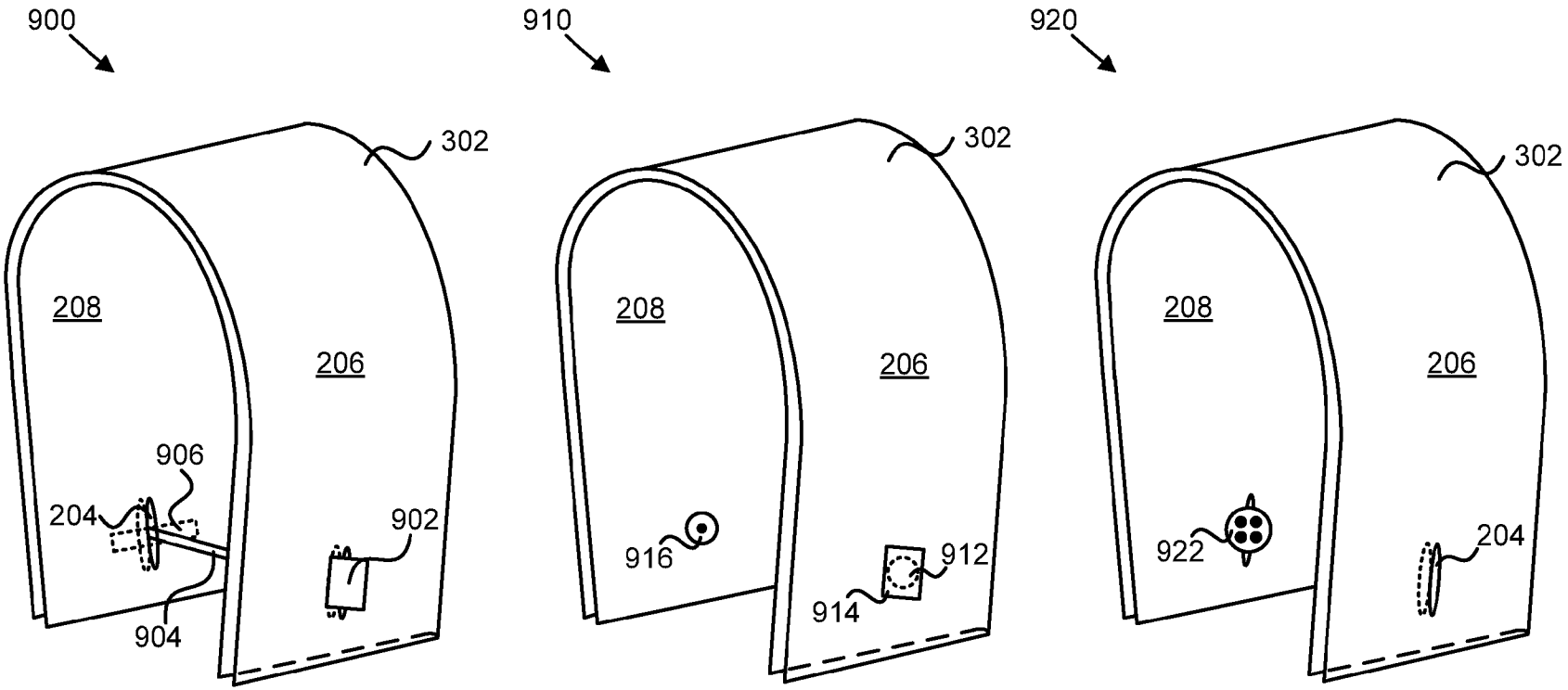
FIG. 9A is a perspective view of one embodiment of a convertible garment cuff with one type of linking member in accordance with the present subject matter.
FIG. 9B is a perspective view of one embodiment of a convertible garment cuff with another type of linking member in accordance with the present subject matter.
FIG. 9C is a perspective view of one embodiment of a convertible garment cuff with yet another type of linking member in accordance with the present subject matter.

In one embodiment, a coupling element couples the ends of the covering region 206, the tucking region 208, and the French cuff 402. The coupling element, in certain embodiments, includes a linking member, such as a cuff link, silk knot, or the like, as shown in FIG. 9A. A cuff link is typically a decorative fastener worn by both men and women to fasten two ends of a cuff of a garment 104, such as a shirt, a dress, trousers, or the like. In one embodiment, the convertible garment cuff 302 may accommodate various shapes and sizes of cuff links. In some embodiments, the cuff link includes a post 906 connecting two coupling members 902, 906, such as small discs or plates. In other embodiments, the cuff link includes a chain connecting two coupling members 902, 906, instead of a post 904.

In other embodiments the linking member may include a silk knot, which is commonly referred to as a "monkey fist." As used herein, a silk knot couples the ends of a cuff 402 using a cord knotted into a ball at both ends. The knotted balls, in most embodiments, couple the ends of the cuff together. In some embodiments, a silk knot is made from various materials, such as silk, cotton, polyester, nylon, or the like. In other embodiments, a silk knot may be made of elastic material and may include a variety of colors.

In another embodiment, the linking member may include a snap, as depicted in FIG. 9B. The snap may include a cap 914 that includes a socket (female) 912 component that operatively connects ("snaps") to a stud (male) 916 component. In some embodiments, the cap 914 may include the stud 916 component that operatively connects to a socket 912 component. In the depicted embodiment, the stud 916 component is mechanically connected to one end of the covering region 206 and the cap 914, with an integrated socket 912 member, is mechanically connected to the opposite end of the covering region 206.

In this manner, the stud 916 component may interface with one or more openings 204 disposed on the ends of the tucking region 208 and one or more openings 404 disposed on the French cuff 402. The stud 916 component may then snap into the socket 912 component to couple the ends of the covering region 206, the tucking region 208, and the French cuff 402 together, securing the convertible garment cuff 302 to the French cuff 402. In some embodiments, the cap 914 includes decorative features to make the cap 914 appear to be a cuff link or other linking member. In other embodiments, the stud 916 component includes decorative features to make the visible portion of the stud 916 component appear to be part of a cuff link or other linking member.

In yet another embodiment, as depicted in FIG. 9C, the linking member may include a standard button 922. The button 922, in one embodiment, is mechanically coupled to one end of the covering region 208 by thread or the like. The convertible garment cuff 302 may accommodate buttons 922 of various sizes and shapes and the openings 204 of the convertible garment cuff 302 may be designed to accept various types of buttons. In some embodiments, the button 922 is mechanically coupled in such a way that there is enough slack between the covering region 206 and the button 922 to allow multiple layers of material to be coupled to the button 922. For example, the button 922 may couple one or more ends of a French cuff 402, one or more ends of a tucking region 208, and at least one end of a covering region 206. In this manner, the convertible garment cuff 302 is secured to the French cuff 402 in an engaged position. In some embodiments, the visible portions of the button 922 may be decorative to match the convertible garment cuff 302 or other clothing items and accessories. In other embodiments, a decorative cap (not shown) may be attached to the button 922.

Referring to FIG. 4, in one embodiment, the linking member interfaces with at least one opening 404 on the French cuff 402 to couple the covering region 206, the tucking region 208, and the French cuff 402 together such that the convertible garment cuff 302 is secured to the French cuff 402 in an engaged position. For example, a cuff link may be received through an opening 204 disposed on one end of the covering region 206, an opening 404 disposed on one end of the French cuff 402, an opening 204 disposed on one end of the tucking region 208 and then another opening 204 disposed on the opposite end of the tucking region 208, an opening 404 disposed on the opposite end of the French cuff 402, and finally an opening 204 disposed on the opposite end of the covering region 206. In this manner, each end of the convertible garment cuff 302 and the French cuff 402 are coupled together and the convertible garment cuff 302 is secured to the French cuff 402 in an engaged position.

In some embodiments, one or more ends of the French cuff 402 may be folded in on itself while the convertible garment cuff 302 is secured in an engaged position, such that the linking member does not interface with one or more openings 404 disposed on the French cuff 402. In this manner, shorter linking members may be used to secure the convertible garment cuff 302 to the French cuff 402. For example, if using a cuff link to secure the convertible garment cuff 302 to the French cuff 402, a cuff link with a shorter post may be used instead of a cuff link with a longer post because there is less material to be coupled together when one or more ends of the French cuff 402 are folded in. In such an embodiment, a secondary coupling element or an anchoring member may be used to maintain the position of the convertible garment cuff 302 on the French cuff 402 and to secure the convertible garment cuff 302 on the French cuff 402 in an engaged position, as shown in FIG. 7.

Figure 10A:
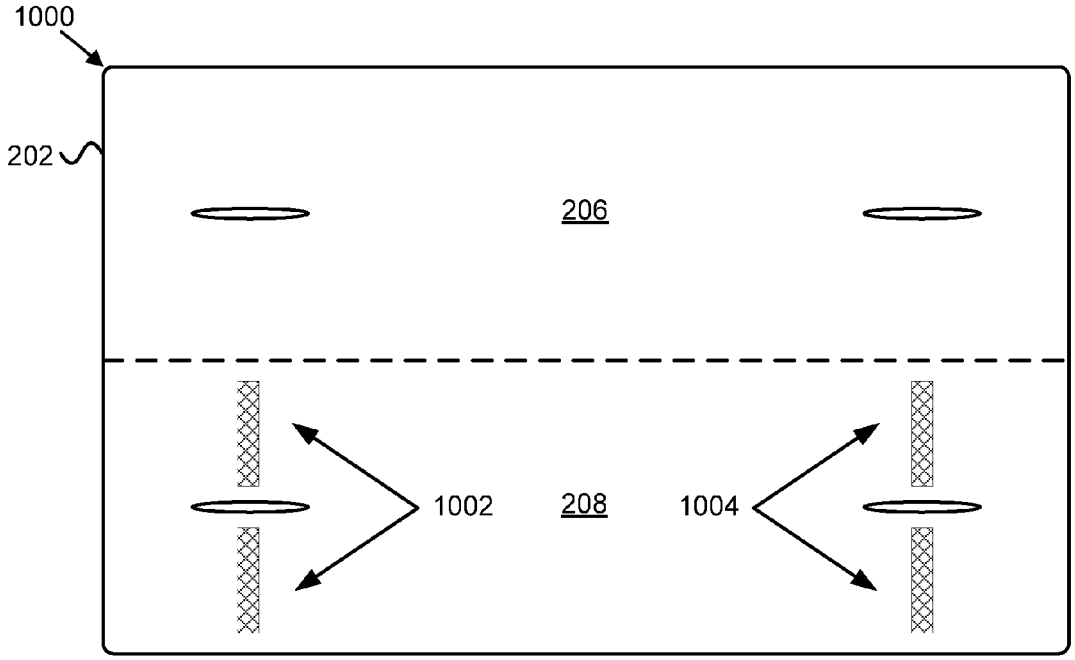
FIG. 10A is perspective view of one embodiment of a back side of a convertible garment cuff with a secondary securing member installed in accordance with the present subject matter.

In other embodiments, it may be beneficial to use an additional coupling element, such as a hook-and-loop fastener, a zipper, magnets or the like. In one embodiment, as depicted in FIG. 10A, hook-and-loop fastener strips 1002, 1004 may be mechanically coupled to each end of the tucking region 208 of the front side 202. As is known in the art, a hook-and-loop fastener that includes a hooking component that includes a plurality of tiny hooks and a looping component that includes a plurality of tiny loops. In one embodiment, the hook-and-loop fastener strip 1002 on one end includes the hooking component and the hook-and-loop fastener strip 1004 on the opposite end includes the looping component. Advantageously, the hook-and-loop fastener strips 1002, 1004 provide additional support for the linking member and help secure the convertible garment cuff 302 to the French cuff 402.

Figure 10B:
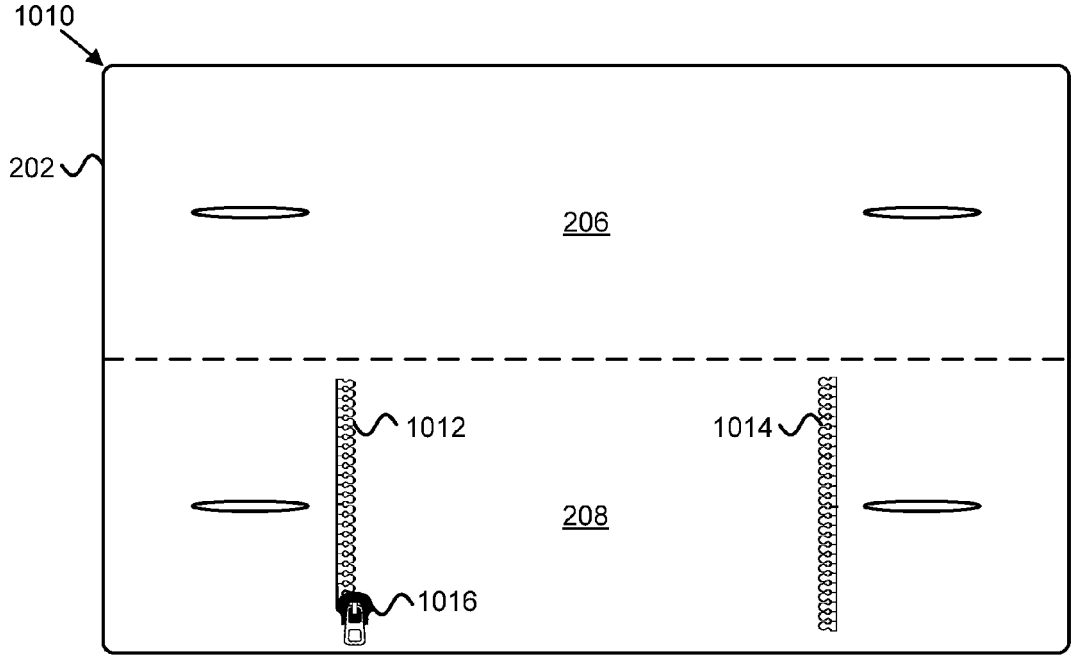
FIG. 10B is perspective view of another embodiment of a back side of a convertible garment cuff with a different secondary securing member installed in accordance with the present subject matter.

In another embodiment, as depicted in FIG. 10B, a zipper 1012, 1014 may be mechanically coupled to each end of the tucking region 208 of the front side 202. In some embodiments, one half of a zipper 1012 includes the zipper slider 1016 and is mechanically coupled to one end of the tucking region 208. In a further embodiment, the other half of a zipper 1014 is mechanically coupled to the opposite end of the tucking region 208. After the convertible garment cuff 302 is installed on a cuff of a garment 104, the halves of the zipper 1012, 1014 may be zipped together using the zipper slider 1016 to provide additional coupling support for the linking member. Beneficially, the zipper, when connected, helps secure the convertible garment cuff 302 to the French cuff 402.

FIG. 5 is a perspective view of another embodiment 500 of installing a convertible garment cuff 302 on a garment 104 that includes a barrel cuff 502. In the depicted embodiment, the barrel cuff 502 may include an opening 504 and a button 506 that is designed to selectively couple to the opening 504. In some embodiments, the barrel cuff 502 may include more than one opening 504 on one end and more than one button 506 on the opposite end. In one embodiment, the convertible garment cuff 302 engages the barrel cuff 502 such that the opening 504 disposed on one end of the barrel cuff 502 aligns with an opening 204 disposed along one end of the covering region 206 and with an opening 204 disposed along one end of the tucking region 208.

In most embodiments, the barrel cuff 502 engages the convertible garment cuff 302 such that the barrel cuff 502 is positioned between the covering region 206 and the tucking region 208. In certain embodiments, the tucking region 208 tucks underneath the barrel cuff 502 and the covering region 206 covers the barrel cuff 502 such that the barrel cuff 402 is concealed from view. In certain embodiments, an end of the barrel cuff 502 that includes a button 506 may be folded 508 in on itself in order to not prevent a coupling element, such as a cuff link, from interfacing with the one or more openings 204 in the covering region 206, the tucking region 208, and the barrel cuff 502 when the convertible garment cuff 302 is coupled to the barrel cuff 502 in an engaged position.

In one embodiment, a coupling element comprises a one or more connecting members that connect the body of the convertible garment cuff 302 to one or more buttons 506 disposed on the barrel cuff 502. For example, a connecting member may include a looped cord or thread that loops over the button 506 to secure the convertible garment cuff 302 to the barrel cuff 502 in an engaged position. In another embodiment, the convertible garment cuff 302 may include an opening 204 that receives the button 506 on the end of the barrel cuff 502 and couples the barrel cuff 502 to the convertible garment cuff 302 in an engaged position.

Similar to the embodiment involving a French cuff 402 described above, in one embodiment, a coupling element couples the ends of the covering region 206, the tucking region 208, and the barrel cuff 502. The coupling element, in certain embodiments, includes a linking member, such as a cuff link, silk knot, or the like, as shown in FIG. 9A and described in detail above. In another embodiment, the linking member may include a snap, as depicted in FIG. 9B. In yet another embodiment, as depicted in FIG. 9C, the linking member may include a standard button. The linking members used in the depicted embodiment in FIG. 5 are substantially similar to the linking members used in the depicted embodiment in FIG. 4. In other embodiments, the linking members may include an additional connecting member that attaches the button 506 or button opening 504 to the linking member, such as a loop, a clasp, or the like.

In one embodiment, a linking member interfaces with at least one opening 504 on the barrel cuff 502 to couple the covering region 206, the tucking region 208, and the barrel cuff 502 together such that the convertible garment cuff 302 is secured to the barrel cuff 502 in an engaged position. For example, a cuff link may be received through an opening 204 disposed on one end of the covering region 206, an opening 504 disposed on one end of the barrel cuff 502, an opening 204 disposed on one end of the tucking region 208 and then another opening 204 disposed on the opposite end of the tucking region 208, and finally an opening 204 disposed on the opposite end of the covering region 206, bypassing the end of the barrel cuff 502 that includes the button 506. In certain embodiments, the end of the barrel cuff 502 that includes the button 506 is folded in on itself while the convertible garment cuff 302 is secured to the barrel cuff 502 in an engaged position. In this manner, each end of the convertible garment cuff 302 and at least one end of the barrel cuff 502 are coupled together and the convertible garment cuff 302 is secured to the barrel cuff 502 in an engaged position.

Figure 6:
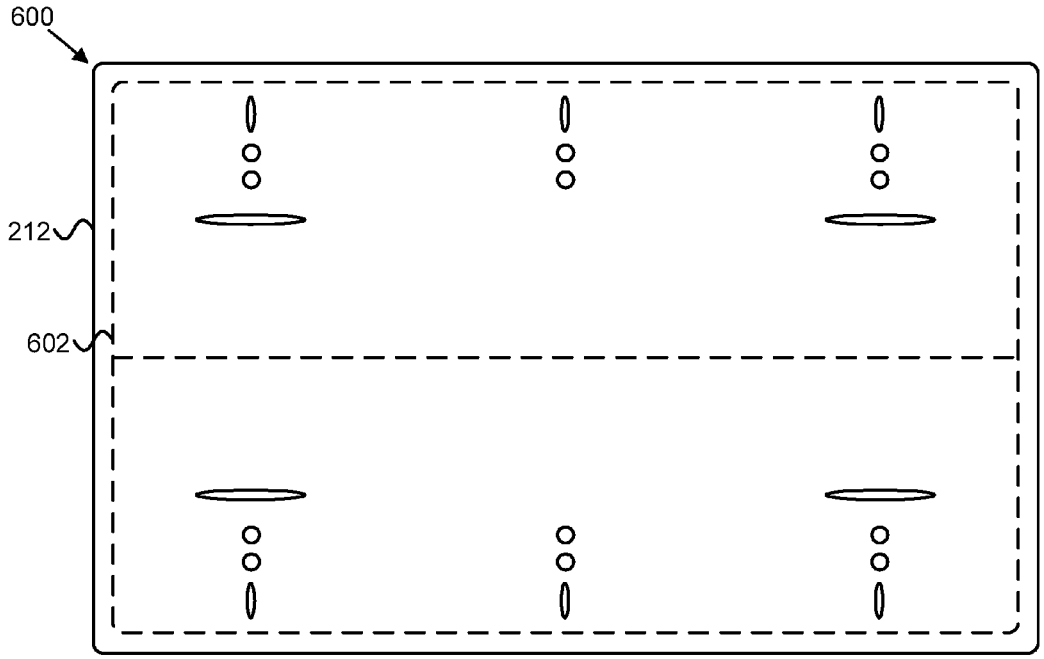
FIG. 6 is a perspective view of another embodiment of a back side of a convertible garment cuff in accordance with the present subject matter.

FIG. 6 is a perspective view of another embodiment 600 of a back side 212 of a convertible garment cuff 302, which is substantially similar to the embodiment 210 depicted in FIG. 2B. In one embodiment, the convertible garment cuff 302 includes an interfacing 602 mechanically coupled to the back side 212 of the convertible garment cuff 302. The interfacing 602, in one embodiment, is a band of flexible material having substantially the same size as the body of the convertible garment cuff 302. In another embodiment, the interfacing 602 reinforces the body of the convertible garment cuff 302 to give the convertible garment cuff 302 support and structure, typically making the convertible garment cuff 302 more rigid than the garment 104. Beneficially, interfacing 602 strengthens certain areas of a material that may be susceptible to tearing, such as where openings are sewn. Additionally, interfacing 602 may help to keep flexible materials, such as fabrics, from stretching out of shape.

The interfacing 602 may include interfacing material of different sizes and weights. In some embodiments, the weight of the interfacing 602 depends on the weight of the material being used. For example, a heavier weight interfacing 602 may be better suited for a convertible garment cuff 302 using a lighter weight material, and vice-versa. In some embodiments, an interfacing 602 may not be used, for example, if the material used for the convertible garment cuff 302 is heavy enough to maintain the structure and support of the convertible garment cuff 302.

In some embodiments, the interfacing 602 is sewn into the convertible garment cuff 302. In one embodiment, the interfacing 602 is attached directly to the back side 212 of the convertible garment cuff 302. In other embodiments, the interfacing 602 is disposed between two bands of material and attached into the convertible garment cuff 302, the first band of material being the front side 202 and the second band of material being the back side 212. In another embodiment, the interfacing 602 includes a fusible interfacing that includes a heat-activated adhesive on one side of the interfacing 602. In such an embodiment, the interfacing may be affixed to the convertible garment cuff 302 by applying heat and pressure.

FIG. 7 is a perspective view of one embodiment 700 of a convertible garment cuff 302 with a backing 702 installed. The backing 702 may be designed to help maintain the placement of the convertible garment cuff 302 on the garment 104. In one embodiment, the backing 702 may include a rubberized material that is mechanically connected to the tucking region 208. In another embodiment, the backing 702 includes an adhesive material such that the convertible garment cuff 302 adheres to the garment 104 in an engaged position. The backing 702, in yet another embodiment, may be sprayed on to the tucking region 208. The spray-on backing 702 may include a rubber backing, an adhesive backing, or the like.

In some embodiments, the backing 702 comprises a surface that substantially matches the appearance of the convertible garment cuff 302, such as the print, color, texture, or the like. In other embodiments, the backing 702 is comprised of a clear material, such as a clear rubberized material or a clear adhesive material, such that the appearance of the convertible garment cuff 302 is visible through the backing 702.

In one embodiment, the backing 702 can be added and removed as needed. The backing 702 may include an adhesive such that the backing 702 adheres to the tucking region 208 of the convertible garment cuff 302. In other embodiments, the backing 702 is connected to a linking member while the convertible garment cuff 302 is secured to the cuff of the garment 104 in an engaged position. For example, the backing 702 may include one or more openings disposed on each end of the backing 702 that are coupled to the linking member when the convertible garment cuff 302 is installed on a garment 104. In another embodiment, the backing 702 includes a hook-and-loop fastener strip, such as Velcro®, that attaches to a corresponding hook-and-loop fastener strip attached to the tucking region 208 of the convertible garment cuff 302 such that the backing 702 is mechanically connected to the convertible garment cuff 302 using the hook-and-loop fastener. In some embodiments, two or more backing 702 elements may be connected to the tucking region 208.

In one embodiment, the backing 702 is substantially the same shape and size as the body of the convertible garment cuff 302. In another embodiment, the backing 702 has a width that is narrower than the body of the convertible garment cuff 302. In other embodiments, the backing 702 may include one or more magnets attached to the tucking region 208 and the covering region 206 that help secure the convertible garment cuff 302 to the garment 104. For example, one or more magnets may be attached to the tucking region 208, either to the surface of the tucking region 208 or sewn into the body of the tucking region 208, or both. One or more corresponding magnets may be attached to the covering region 206, either to the hidden surface of the covering region 208 or sewn into the body of the covering region 208, or both. The magnets may then attract and pull towards each other, securing the convertible garment cuff 302 to the garment 104. The magnets may be any shape and size as long as they are not visible while the convertible garment cuff 302 is secured to the garment 104 and they do not hinder the flexibility of the convertible garment cuff 302.

In another embodiment, the convertible garment cuff 302 may include a clip sewn into the body of the tucking region 208 or mechanically coupled to the surface of the tucking region 208, or both. The clip may help secure the convertible garment cuff 302 to a cuff of the garment 104 by tightly fitting the convertible garment cuff 302 to the garment 104. In most embodiments, the clip is made of substantially rigid material, such as metal, rigid plastics, or the like. In another embodiment, the convertible garment cuff 302 may be secured to the garment 104 using hook-and-loop fastener. In one embodiment, for example, a hook-and-loop fastener strip may be attached to the cuff of the garment 104 while the corresponding hook-and-loop fastener strip may be attached to the tucking region 208 of the convertible garment cuff 302. In such an embodiment, the hook-and-loop fastener strips may be fastened to each other to secure the convertible garment cuff 302 to the garment 104 in an engaged position.

Beneficially, the backing 702 may help secure the placement of the convertible garment cuff 302 on the cuff of the garment 104 to prevent the convertible garment cuff 302 from moving around on the garment 104. Additionally, the backing 702 may help secure the convertible garment cuff 302 to the garment 104 in circumstances where a linking member may not be sufficient to secure the convertible garment cuff 302 to the garment 104 in an engaged position. The backing 702 may also be useful to help secure the convertible garment cuff 302 to an awkward cuff of a garment 104, such as jeans, a dress, or a collar.

Figure 8A:
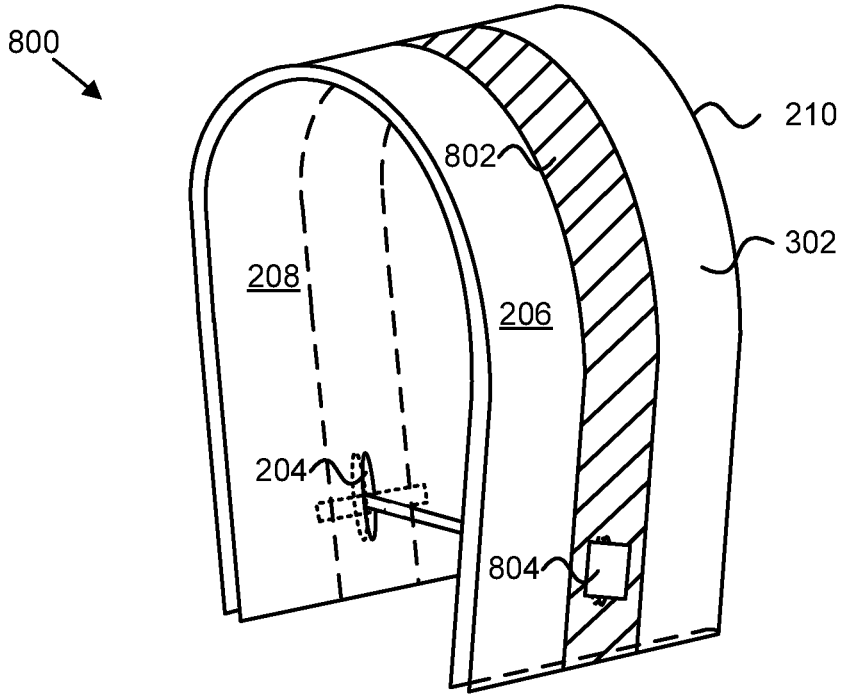
FIG. 8A is a perspective view of one embodiment of a convertible garment cuff with an accessory installed in accordance with the present subject matter.

FIG. 8A is a perspective view of one embodiment 800 of a convertible garment cuff 302 with an accessory installed. In one embodiment, one or more accessories may be attached to the convertible garment cuff 302. In certain embodiments, an accessory may be mechanically attached to the surface of the covering region 208. In another embodiment, an accessory may be coupled to the convertible garment cuff 302 by a coupling element, such as a linking member. One or more accessories, in other embodiments, may be interchangeable in order to change the appearance of the convertible garment cuff 302 on the fly.

For example, as depicted in FIG. 8A, an accessory may include a strip of material 802, such as a ribbon, lace, or the like, that is coupled to the convertible garment cuff 302 by attaching each end of the material 802 to each end of a linking member 804. Alternatively, a user may uncouple the strip of material 802 from the linking member 804 and insert a different strip of material 802. In another embodiment, the strip of material 802 may include an additional element to connect to the covering region 206, such as a button. For example, the button may be between the openings 204 at either end of the convertible garment cuff 102. Alternatively, the strip of material 802 may be more permanently attached to the convertible garment cuff 302 by being mechanically connected to the surface of the covering region 206, such as by being sewn, adhered, and/or the like.

In other embodiments, the strip of material 802 may use hook-and-loop fastener to attach to the convertible garment cuff 302. The strip of material 802 may include a hook-and-loop fastener strip on its backside that mates to a corresponding hook-and-loop fastener strip coupled to the surface of the covering region 206. The strip of material may be various widths and include a variety of prints, textures, colors, or the like. The strip of material may also be various lengths, depending on how the strip of material is attached to the convertible garment cuff 302.

Figure 8B:
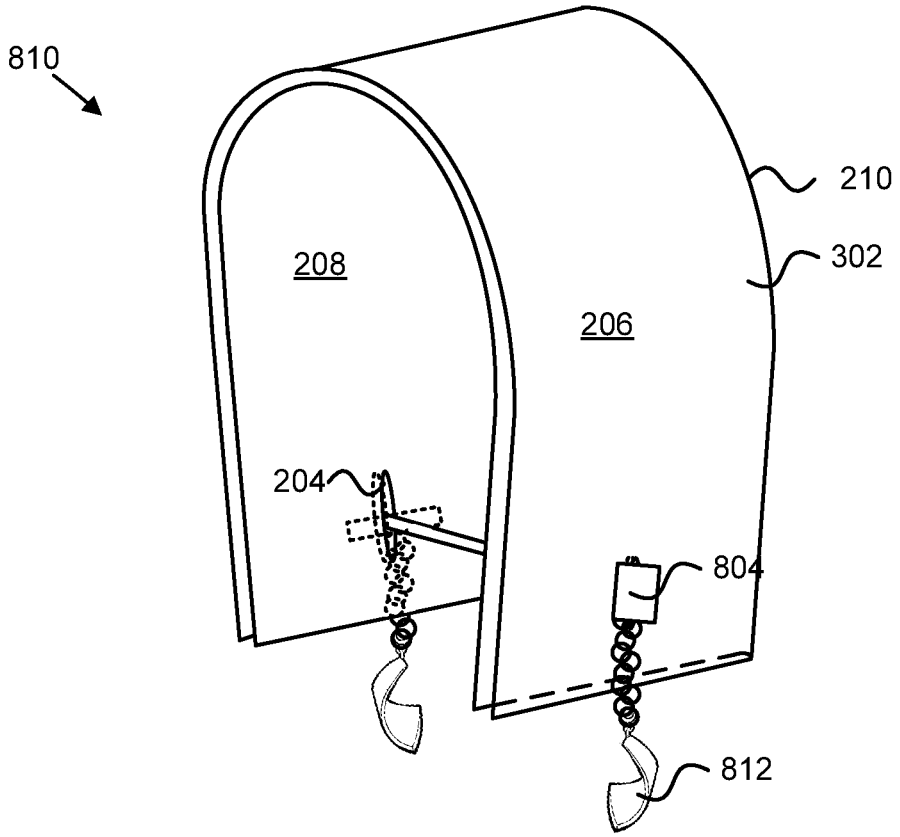
FIG. 8B is a perspective view of another embodiment of a convertible garment cuff with an accessory installed in accordance with the present subject matter.

FIG. 8B is a perspective view of an embodiment 810 of a convertible garment cuff 302 with a jewelry accessory 812 installed. In one embodiment, jewelry 812 may be coupled to the convertible garment cuff 302 to add a touch of personal adornment to the convertible garment cuff 302. The jewelry 812, in other embodiments, is coupled to the convertible garment cuff 302 by the linking member 804. In other embodiments, the jewelry 812 is mechanically coupled to the convertible garment cuff 302, such as by being sewn, adhered, and/or the like, to the convertible garment cuff 302.

The jewelry may include chains, rings, charms, or the like, and may include various materials, such as gold, platinum, silver, diamonds, and/or the like. Similar to the interchangeable strips of material 802 depicted in FIG. 8A, the jewelry 812 may also be interchangeable and/or may be combined with a strip of material 802, other jewelry 812, or other accessories.

In some embodiments, a user may customize the convertible garment cuff 302. Customizations may include selecting from different prints and/or colors. In other embodiments, a user may customize a convertible garment cuff 302 by adding embroidery. For example, a user may specify a name, logo, design, or the like, to be embroidered on the convertible garment cuff 302. In some embodiments, the embroidery may be disposed on the visible surface of the covering region 206. In other embodiments, the embroidery may be disposed on a hidden surface of the convertible garment cuff 302.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

a band of flexible material comprising a substantially rectangular body having first and second opposing edges, first and second opposing ends, a front side, and a back side;

a portion of the body comprising a covering region, the covering region concealing a garment cuff in an engaged position;

a portion of the body comprising a tucking region, the tucking region tucking underneath the garment cuff in an engaged position, wherein the covering region and the tucking region are separated by a fold, the covering region between the first opposing edge and the fold and the tucking region between the second opposing edge and the fold; and a coupling element securing the body to the garment cuff in an engaged position, the coupling element comprising a cuff link, at least one opening disposed along each of the first and second opposing ends of the covering region, and at least two openings disposed along each of the first and second opposing ends of the tucking region, wherein an opening on the first opposing end of the tucking region corresponds with an opening on the second opposing end of the tucking region such that the first and second opposing ends of the covering region and the tucking region are coupled together using one of the at least two openings on the first and second opposing ends of the tucking region with the cuff link, wherein corresponding openings of the at least two openings on the first and second opposing ends of the tucking region are spaced along the first and second opposing ends of the tucking region a different distance from the second opposing edge such that aligning a first pair of corresponding openings of the two or more openings on the first and second opposing ends of the tucking region creates a different length of the covering region and a different location of the fold than aligning a second pair of corresponding openings of the two or more opening on the first and second opposing ends of the tucking region.

2. The apparatus of claim 1, wherein the body is folded lengthwise such that the covering region overlaps the tucking region, the folded body forming an arc shape and engaging the garment cuff such that the garment cuff is positioned between the covering region and the tucking region.

3. The apparatus of claim 2, wherein the garment cuff engages the body such that one or more openings disposed along each of the first and second edges of the covering region and the tucking region and one or more openings disposed on the garment cuff are aligned.

4. The apparatus of claim 3, wherein the cuff link is received through the one or more aligned openings disposed on the covering region, the tucking region, and the garment cuff to secure the body to the garment cuff in an engaged position.

5. The apparatus of claim 1, wherein the garment cuff is wearable as a barrel cuff, wherein openings of the plurality of openings align in a barrel configuration and are secured with the cuff link.

6. The apparatus of claim 1, wherein a portion of the tucking region of the cuff comprises one or more buttons and accompanying openings, the portion of the tucking region of the cuff comprising one or more buttons being folded in on itself and the one or more buttons connected to the accompanying openings to hold the portion of the tucking region being folded away from where the plurality of openings in the covering region align while coupled in an engaged position.

7. The apparatus of claim 1, wherein the garment cuff comprises a French cuff, the cuff link interfacing with at least one opening disposed on the French cuff, the body being secured to the French cuff in an engaged position.

8. The apparatus of claim 1, further comprising an interfacing mechanically connected to the back side to reinforce the body, the interfacing comprising a band of flexible material substantially the same size as the body.

9. The apparatus of claim 1, wherein a width of the body is adjustable by coupling at least one opposing edge to the back side, the opposing edge coupled to the back side by one or more fastening members, wherein the width of the body is a dimension between the first and second opposing edges.

10. The apparatus of claim 1, further comprising one or more accessories, an accessory being coupled to one or more of the body and the cuff link.

11. The apparatus of claim 10, wherein the one or more accessories comprises a band of flexible material selectively coupled to the first and second opposing ends by the cuff link, the band of flexible material being narrower than the body and covering a portion of the front side.

12. The apparatus of claim 10, wherein the one or more accessories comprises jewelry, the jewelry being selectively coupled to the body by the cuff link.

13. The apparatus of claim 1, further comprising a backing element attached to the body, the backing element maintaining the placement of the body on the garment cuff in an engaged position.

14. The apparatus of claim 1, wherein the body comprises first and second bands of flexible material having substantially the same size and shape, the first and second bands of flexible material comprising different visual appearances and being mechanically connected such that the body is reversible wherein the back side and the front side are interchangeable.

15. A garment cuff converter comprising:

a band of fabric comprising a substantially rectangular body having first and second opposing edges, first and second opposing ends, a front side, and a back side;

a portion of the body comprising a covering region, the covering region concealing a garment cuff in an engaged position and comprising one or more openings disposed along each of the first and second ends opposing;

a portion of the body comprising a tucking region, the tucking region tucking underneath the garment cuff in an engaged position and comprising two or more openings disposed along each of the first and second opposing ends; and a cuff link securing the body to the garment cuff in an engaged position wherein the one or more openings disposed along each of the first and second opposing ends of the covering region, the two or more openings disposed along each of the first and second opposing ends of the tucking region, and one or more openings disposed on the garment cuff are aligned such that the cuff link is received through each opening to couple the covering region, the tucking region, and the garment cuff together, wherein corresponding openings of the at least two openings on the first and second opposing ends of the tucking region are spaced along the first and second opposing ends of the tucking region a different distance from the opposing edge of the tucking region such that aligning a first pair of corresponding openings of the two or more openings on the first and second opposing ends of the tucking region creates a different length of the covering region than aligning a second pair of corresponding openings of the two or more openings on the first and second opposing ends of the tucking region.

16. The garment cuff converter of claim 15, wherein the garment cuff comprises a barrel cuff, the cuff link interfacing with at least one opening disposed on the barrel cuff to secure the body to the barrel cuff in an engaged position.

17. The garment cuff converter of claim 15, wherein the garment cuff comprises a French cuff, the cuff link interfacing with at least one opening disposed on the French cuff to secure the body to the French cuff in an engaged position.

18. A garment cuff converter comprising:

a band of fabric comprising a substantially rectangular body having first and second opposing edges, first and second opposing ends, a front side, and a back side;

a portion of the body comprising a covering region, the covering region concealing a garment cuff in an engaged position and comprising one or more openings disposed along each of the first and second opposing ends;

a portion of the body comprising a tucking region, the tucking region tucking underneath the garment cuff in an engaged position and comprising two or more openings disposed along each of the first and second opposing ends;

an interfacing mechanically connected to the back side to reinforce the body, the interfacing comprising a band of flexible material substantially the same size as the body;

a cuff link securing the body to the garment cuff in an engaged position, the body being folded over itself lengthwise such that the covering region overlaps the tucking region, the folded body forming an arc shape and engaging the garment cuff such that the garment cuff is positioned between the covering region and the tucking region, the one or more openings disposed along each of the first and second opposing ends of the covering region, the two or more openings disposed along each of the first and second opposing ends of the tucking region, and one or more openings disposed on the garment cuff being aligned such that the cuff link is received through each opening to couple the covering region, the tucking region, and the garment cuff together, wherein corresponding openings of the at least two openings on the first and second opposing ends of the tucking region are spaced along the first and second opposing ends of the tucking region a different distance from the opposing edge of the tucking region such that aligning a first pair of corresponding openings of the two or more openings on the first and second opposing ends of the tucking region creates a different length of the covering region than aligning a second pair of corresponding openings of the two or more openings on the first and second opposing ends of the tucking region; and hook-and-loop fastener strips attached to the tucking region and aligned with the two or more openings of the tucking region and equidistant from the first and second opposing ends, the hook-and-loop fastener strips secured together in the engagement position in addition to the cuff link securing the body to the garment cuff in the engagement position.

19. The apparatus of claim 1, further comprising hook-and-loop fastener strips attached to the tucking region and aligned with the two or more openings of the tucking region and positioned equidistant from the first and second opposing ends, the hook-and-loop fastener strips secured together in the engagement position in addition to the cuff link securing the body to the garment cuff in the engagement position.

20. The apparatus of claim 9, wherein the one or more fastening members comprise a plurality of openings disposed along an opposing edge of one or more of the covering region and the tucking region and one or more corresponding buttons aligned with the plurality of openings and further toward a fold between the tucking region and the covering region such that coupling the plurality of openings along an opposing edge to a set of corresponding buttons adjusts the width of the body.

* * * * *